US010099885B2

(12) United States Patent
Hirata et al.

(10) Patent No.: US 10,099,885 B2
(45) Date of Patent: Oct. 16, 2018

(54) CONVEYING APPARATUS

(71) Applicant: BROTHER KOGYO KABUSHIKI KAISHA, Nagoya-shi, Aichi-ken (JP)

(72) Inventors: Kenichi Hirata, Nagoya (JP); Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/710,206

(22) Filed: Sep. 20, 2017

(65) Prior Publication Data

US 2018/0093845 A1 Apr. 5, 2018

(30) Foreign Application Priority Data

Sep. 30, 2016 (JP) ..... 2016-194013

(51) Int. Cl.
*B65H 29/60* (2006.01)
*B65H 29/58* (2006.01)
*G03G 15/00* (2006.01)

(52) U.S. Cl.
CPC ..... *B65H 29/60* (2013.01); *B65H 29/58* (2013.01); *B65H 2402/10* (2013.01);
(Continued)

(58) Field of Classification Search
CPC .... B65H 29/58; B65H 29/60; B65H 2402/10; B65H 2402/40; B65H 2408/111; B65H 2408/1164
(Continued)

(56) References Cited

U.S. PATENT DOCUMENTS 3,868,019 A * 2/1975 Stemmle ..... B07C 3/00 211/126.1
4,095,782 A * 6/1978 Breuers ..... B65H 29/60 271/292
(Continued)

FOREIGN PATENT DOCUMENTS

JP 9-304990 A 11/1997
JP 2771982 B2 7/1998
(Continued)

OTHER PUBLICATIONS

Computer translation of Japanese Patent Application No. 1220677, which corresponds to JP 2771982.

*Primary Examiner* — David H Bollinger
(74) *Attorney, Agent, or Firm* — Merchant & Gould P.C.

(57) ABSTRACT

A conveying apparatus, including: a main body unit including a conveyor mechanism, a first tray to receive a medium conveyed through a first conveyance path, and a switcher to switch a destination of the medium; an intermediate unit removably mountable on the upper surface of the main body unit and including a first introduction opening formed in its lower surface and at least one conveyance roller for conveying the medium through a second conveyance path and discharging the medium from a second discharge opening formed in its upper surface; and a tray unit removably mountable on the upper surface of the intermediate unit and including a second introduction opening formed in its lower surface and at least one second tray to receive the medium conveyed through a third conveyance path, the intermediate unit having a length in a height direction smaller than that of the tray unit in the direction.

14 Claims, 9 Drawing Sheets

(52) U.S. Cl.
CPC .... *B65H 2402/40* (2013.01); *B65H 2408/111* (2013.01); *B65H 2408/1164* (2013.01); *G03G 15/6538* (2013.01)

(58) Field of Classification Search
USPC ..... 271/303
See application file for complete search history.

(56) References Cited

U.S. PATENT DOCUMENTS 5,810,353 A * 9/1998 Baskette ..... B65H 29/60 271/279
5,860,644 A * 1/1999 Takeuchi ..... B41J 13/00 271/298
6,308,952 B1 * 10/2001 Takagi ..... B65H 31/22 271/297
6,331,003 B1 * 12/2001 Yokota ..... B65H 29/60 271/287
6,443,449 B1 * 9/2002 Takagi ..... B65H 31/22 271/279
6,634,640 B1 * 10/2003 Yoshizawa ..... B65H 31/22 271/213
2004/0256790 A1 * 12/2004 Saito ..... B65H 29/60 271/186
2015/0274469 A1 * 10/2015 Mori ..... B65H 15/00 271/291
2016/0271932 A1 * 9/2016 Tanaka ..... B65H 31/02
2016/0280496 A1 * 9/2016 Masuda ..... B65H 29/58
2018/0029821 A1 * 2/2018 Takaba ..... B65H 43/00

FOREIGN PATENT DOCUMENTS

JP 11-65198 A 3/1999
JP 11-157731 A 6/1999

* cited by examiner 1
35
35
35
35
D35
D35
D35
D35
31
30
32
33ca
33c
32
33ca
33c
32
33ca
33c
32
33ca
33c
32
31x
H30
41
40
41
41a
31a
R30
21y
21a
20
22
R20
21
H20
22
21x
11x
R10b
11a
13c
Rx
10
13a
13a
11
13a
13a
13a

CONVEYING APPARATUS

CROSS REFERENCE TO RELATED APPLICATION

The present application claims priority from Japanese Patent Application No. 2016-194013, which was filed on Sep. 30, 2016, the disclosure of which is herein incorporated by reference in its entirety.

BACKGROUND

Technical Field

The following disclosure relates to a conveying apparatus in which an optional unit having at least one optional receiving tray is mounted on a main body having a receiving tray via an intermediate unit.

Description of Related Art

In the field of conveying apparatuses, there has been known a technique of mounting an optional unit having at least one optional receiving tray on a main body of the apparatus having a receiving tray via an intermediate unit. In a known copying machine (main body), for instance, an upright portion (intermediate unit) including a conveyance path is mounted on one side of the copying machine, and a sorter (optional unit) is removably mounted on an upper end portion of the upright portion.

In an instance where the optional unit is mounted on the main body via the intermediate unit, the structure of the intermediate unit (the structure of a connector of the intermediate unit connecting the intermediate unit to the main body) is changed depending upon types of the main body while the structure of the optional unit is made common for various types of the main body, thereby eliminating a need for developing various optional units to be used exclusively for respective types of the main body. It is thus possible to reduce the cost of developing the optional unit.

The known conveying apparatus in which the intermediate unit is mounted on one side of the main body and the optional unit is mounted on the upper end portion of the intermediate unit inevitably has a large footprint on the horizontal plane. In the known conveying apparatus, the intermediate unit mounted on one side of the main body is located at a height level higher than a lower surface of the main body, and the optional unit is mounted on the upper end portion of the thus mounted intermediate unit. According to this configuration, the center of gravity of the apparatus as a whole is located outside a region occupied or taken up by the apparatus on the horizontal plane, causing instability in posture of the apparatus as a whole and resulting in a risk that the apparatus falls over or topples over.

Accordingly, an aspect of the disclosure relates to a conveying apparatus having a construction in which an optional unit is mounted on a main body via an intermediate unit, the conveying apparatus obviating an increase in a footprint of the apparatus as a whole on a horizontal plane and having a reduced risk of falling over or toppling over.

One aspect of the disclosure relates to a conveying apparatus, including: a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit; an intermediate unit mountable on and removable from the upper surface of the main body unit, the intermediate unit including a first introduction opening formed in a lower surface thereof so as to be opposed to the first discharge opening, a second conveyance path through which the medium that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

First Embodiment

Figure 1:
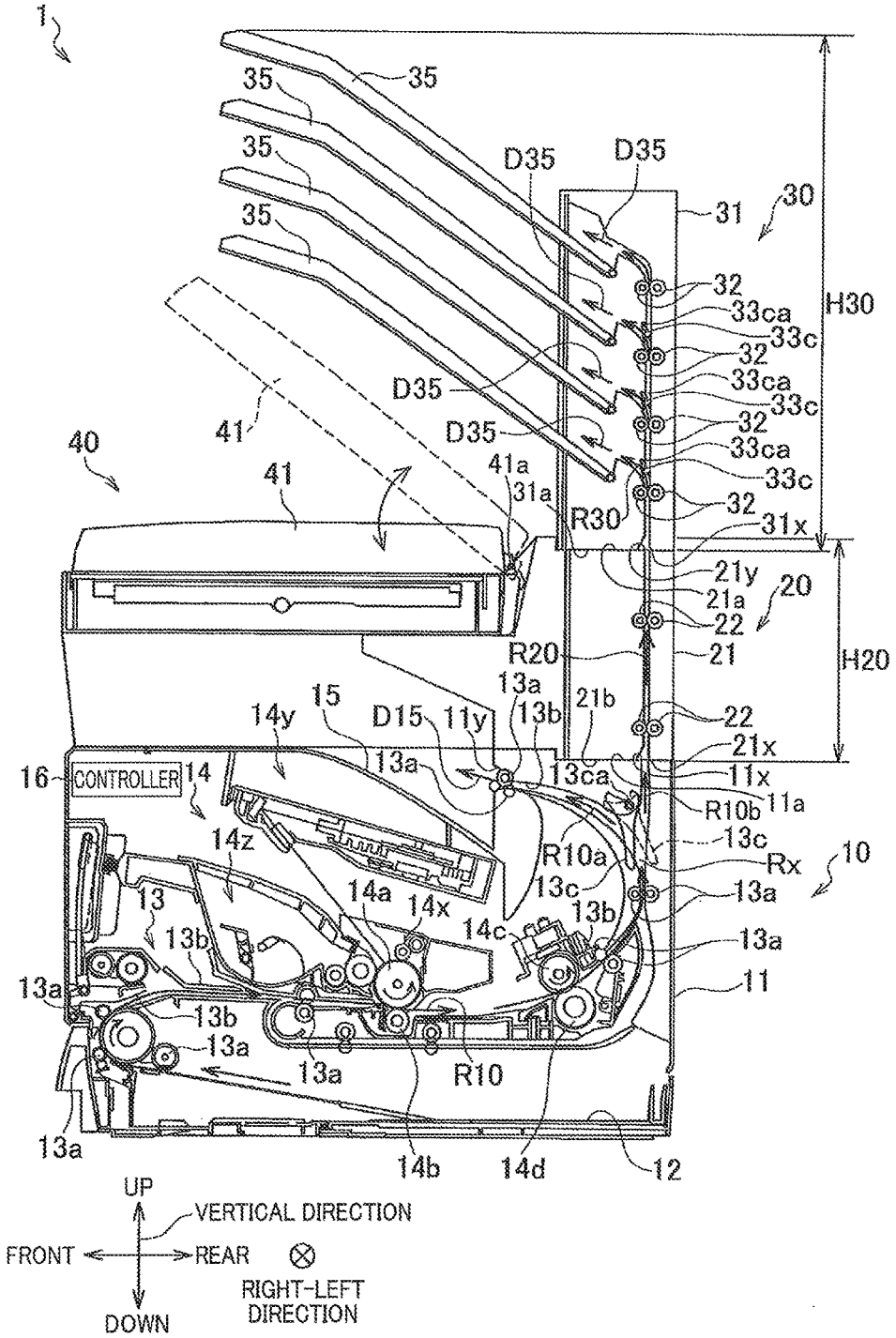
FIG. 1 is a schematic view of a printer according to a first embodiment.

Referring first to FIG. 1, there will be explained an overall structure of a printer 1 according to a first embodiment of the present disclosure.

In the following explanation, a left side and a right side in FIG. 1 are respectively defined as a front side and a rear side of the printer 1. A side corresponding to a front surface of the drawing sheet of FIG. 1 and a side corresponding to a back surface of the drawing sheet of FIG. 1 are respectively defined as a right side and a left side of the printer 1. Further, an upper side and a lower side in FIG. 1 are respectively defined as an upper side and a lower side of the printer 1.

The printer 1 includes a main body 10 (as one example of "main body unit"), an intermediate unit 20, an optional unit 30 (as one example "tray unit"), and a scanner unit 40.

The main body 10 includes a housing 11, a storage tray 12, a conveyor mechanism 13, an image former 14, a receiving tray 15 (as one example of "first tray"), and a controller 16. The storage tray 12 is provided at a lower portion of the housing 11 and is capable of storing a plurality of sheets (each as one example of "medium") to be conveyed by the conveyor mechanism 13. The receiving tray 15 is provided at an upper portion of the housing 11 and is capable of receiving the sheets that have been conveyed by the conveyor mechanism 13. The controller 16 includes a central processing unit (CPU), a read only memory (ROM), and a random access memory (RAM) and controls devices of the printer 1 based on a command sent from an external apparatus such as a personal computer (PC) connected to the printer 1.

The housing 11 has a generally rectangular parallelepiped shape and houses the storage tray 12, the conveyor mechanism 13, the image former 14, and the controller 16. The receiving tray 15 is constituted by an upper surface 11*a* of the housing 11. A discharge opening 11*x* (as one example of "first discharge opening"), through which the sheet conveyed by the conveyor mechanism 13 is discharged outside the housing 11, is formed in a region of the upper surface 11*a* of the housing 11 in which the receiving tray 15 is not provided, namely, the discharge opening 11*x* is located rearward of the receiving tray 15. A discharge opening 11*y*, through which the sheet conveyed by the conveyor mechanism 13 is discharged to the receiving tray 15, is formed at an upper portion of the housing 11 between the receiving tray 15 and the discharge opening 11*x*. The receiving tray 15 is disposed downstream of the discharge opening 11*x* in a movement direction D15 in which the sheet moves when received by the receiving tray 15.

The conveyor mechanism 13 is configured to convey the sheet along a path R10 formed in the housing 11 and includes conveyance rollers 13*a*, guides 13*b*, and a switcher 13*c*. The path R10 (as one example of "first conveyance path") includes a path R10*a* extending from the storage tray 12 to the receiving tray 15 and a path R10*b* extending from the storage tray 12 to the discharge opening 11*x*. The path R10*b* is common, at its portion extending from the storage tray 12 to a branch position Rx, to the path R10*a* and branches off from the path R10*a* at the branch position Rx. The switcher 13*c* is disposed at the branch position Rx. The switcher 13*c* is pivotable about a shaft 13*ca* extending in a right-left direction, so as to be movable between: a position (indicated by the dashed line in FIG. 1) at which the switcher 13*c* permits the sheet to be conveyed to the receiving tray 15; and a position (indicated by the solid line in FIG. 1) at which the switcher 13*c* permits the sheet to be conveyed to the discharge opening 11*x*. That is, the conveyor mechanism 13 is configured to convey the sheet selectively to one of the receiving tray 15 and the discharge opening 11*x*.

The image former 14 includes a photoconductive drum 14*a*, a transfer roller 14*b*, a charging unit 14*x*, a laser unit 14*y*, a toner unit 14*z*, a fixing roller 14*c*, and a pressure roller 14*d*. The photoconductive drum 14*a* and the transfer roller 14*b* are disposed upstream of the branch position Rx in the path R10, so as to be in contact with each other with the path R10 interposed therebetween. The fixing roller 14*c* and the pressure roller 14*d* are disposed upstream of the branch position Rx in the path R10 and downstream of the photoconductive drum 14*a* and the transfer roller 14*b*, so as to be in contact with each other with the path R10 interposed therebetween.

The surface of the photoconductive drum 14*a* is charged by the charging unit 14*x* and is irradiated with a laser light emitted from the laser unit 14*y*, so as to form an electrostatic latent image on the surface. Further, toner is applied to the surface from the toner unit 14*z*, so as to form a toner image. The transfer roller 14*b*, to which is applied a voltage opposite to a voltage applied to the photoconductive drum 14*a*, transfers the toner image to the sheet nipped by the photoconductive drum 14*a* and the transfer roller 14*b*. Subsequently, toner is fixed on the sheet by the heat of the fixing roller 14*c* and the pressure of the fixing roller 14*c* and the pressure roller 14*d*. Thus, an image is formed on the sheet by the image former 14.

The intermediate unit 20 includes a housing 21 and conveyance rollers 22.

The housing 21 is mountable on and removable from the upper surface 11*a* of the housing 11 and houses the conveyance rollers 22. An introduction opening 21*x* (as one example of "first introduction opening") corresponding to the discharge opening 11*x* is formed in a lower surface 21*b* of the housing 21. A discharge opening 21*y* (as one example of "second discharge opening") that communicates with the introduction opening 21*x* is formed in an upper surface 21*a* of the housing 21. There is formed, in the housing 21, a path R20 (as one example of "second conveyance path") through which the sheet is conveyed from the introduction opening 21*x* to the discharge opening 21*y*. In the present embodiment, the path R20 linearly extends in the vertical direction. The introduction opening 21*x* and the discharge opening 21*y* are arranged in the vertical direction so as to align with each other as seen in the vertical direction.

The conveyance rollers 22 convey the sheet along the path R20. Two pairs of the conveyance rollers 22 are disposed along the path R20 so as to be spaced apart from each other. The conveyance rollers 22 of each pair are in contact with each other with the path R20 interposed therebetween.

The optional unit 30 includes a housing 31, conveyance rollers 32, and four receiving trays 35 (as one example of "at least one second tray").

The housing 31 is mountable on and removable from the upper surface 21*a* of the housing 21 and houses the conveyance rollers 32. (The housing 31 is mountable on and removable from the upper surface 11*a* of the housing 11 in an instance where the intermediate unit 20 is not provided.) An introduction opening 31*x* (as one example of "second introduction opening") corresponding to the discharge opening 21*y* is formed in a lower surface 31*a* of the housing 31.

(The introduction opening 31*x* corresponds to the discharge opening 11*x* in an instance where the housing 31 is mounted on the upper surface 11*a* of the housing 11.) There is formed, in the housing 31, a path R30 (as one example of "third conveyance path") through which the sheet is conveyed from the introduction opening 31*x* to each receiving tray 35. The path R30 includes: a path extending to an uppermost one of the four receiving trays 35; and three paths that branch off from the path at respective three branch positions, so as to respectively extend to the three receiving trays 35 disposed below the uppermost receiving tray 35. Switchers 33*c* similar to the switcher 13*c* are provided at the respective three branch positions. Each switcher 33*c* is pivotable about a corresponding shaft 33*ca* that extends in the right-left direction, so as to be movable between: a position (indicated by the dashed line in FIG. 1) at which the switcher 33*c* permits the sheet to be conveyed to the corresponding receiving tray 35; and a position (indicated by the solid line in FIG. 1) at which the switcher 33*c* permits the sheet to be conveyed upward.

The four receiving trays 35 are arranged in the vertical direction. The four receiving trays 35 are supported at respective proximal portions by the housing 31 and protrude from the housing 31 forward and obliquely upward. A movement direction D35 in which the sheet moves when received by each receiving tray 35 is the same as the movement direction D15. That is, the movement direction D35 is a direction from the rear side toward the front side. The movement direction D35 is one example of "first movement direction", and the movement direction D15 is one example of "second movement direction".

The scanner unit 40 is configured to read an image on the sheet. The scanner unit 40 is supported by the intermediate unit 20 and is disposed at a front portion of the upper surface 21*a* of the housing 21. The scanner unit 40 is disposed at the front portion of the upper surface 21*a* of the housing 21, and the discharge opening 21*y* is formed at a rear portion of the upper surface 21*a* of the housing 21 which is outside a region of the upper surface 21*a* in which the scanner unit 40 is disposed. That is, the scanner unit 40 is disposed downstream of the discharge opening 21*y* in the movement direction D15, D35. In other words, the discharge opening 21*y* is formed in the upper surface 21*a* of the housing 21 so as not to overlap the scanner unit 40 when viewed from above. The scanner unit 40 includes a cover 41 (as one example of "opening and closing member") configured to be openable about a shaft 41*a* located on the upstream side in the movement direction D15, D35 so as to extend in the right-left direction. The cover 41 is disposed below the receiving trays 35.

The scanner unit 40 is disposed below the receiving trays 35 and above the receiving tray 15. That is, the receiving tray 15, the scanner unit 40, and the receiving trays 35 are disposed in this order from the bottom. Respective projective regions obtained by projecting, in the vertical direction, the receiving tray 15, the scanner unit 40, and the receiving trays 35 onto an imaginary plane orthogonal to the vertical direction at least partially overlap one another. The intermediate unit 20 has a length H20 in a height direction smaller than a length H30 of the optional unit 30 in the height direction.

Figure 2:
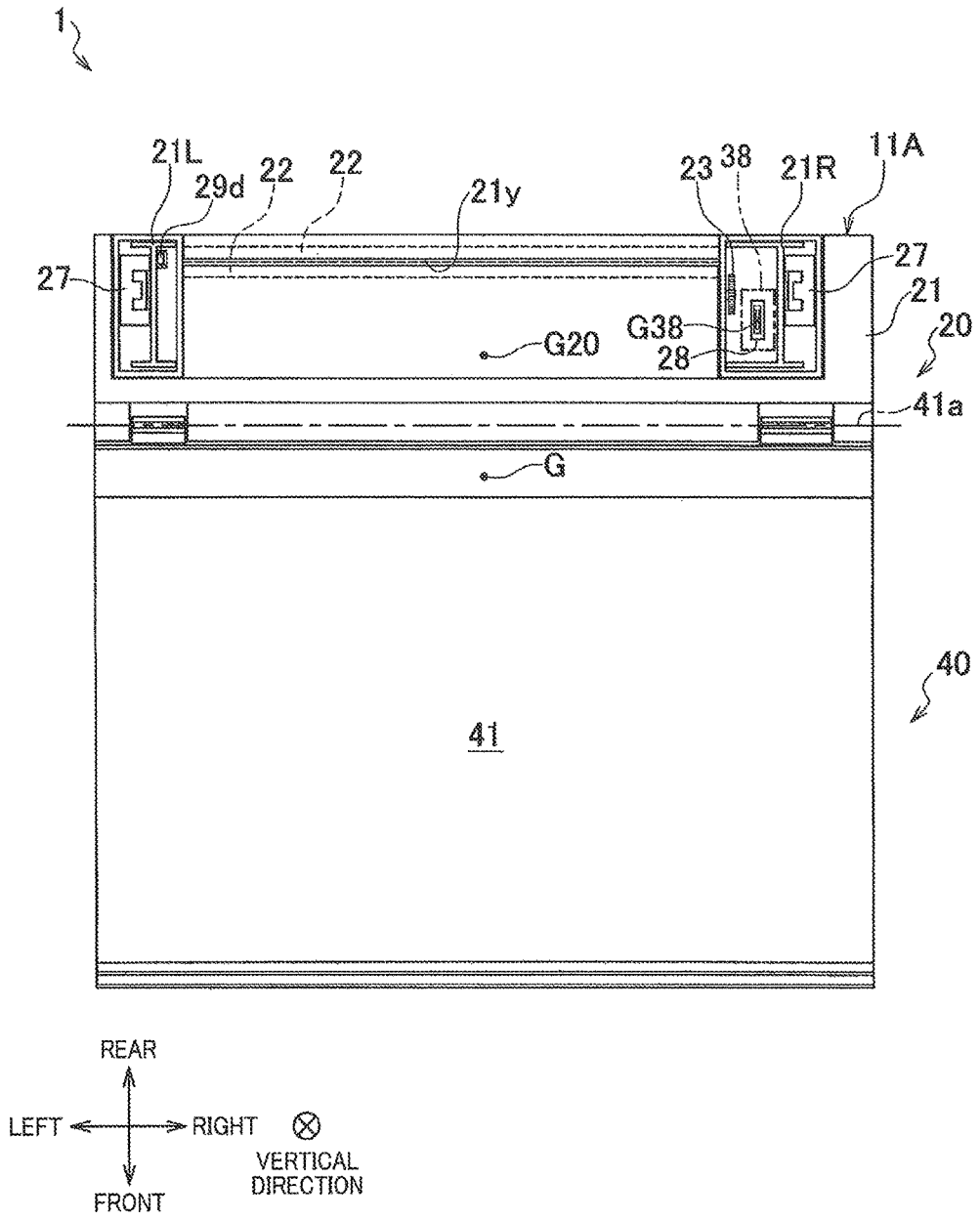
FIG. 2 is a plan view of the printer of the first embodiment from which an optional unit is removed.

Referring next to FIGS. 2-4, the main body 10, the intermediate unit 20, and the optional unit 30 will be explained in detail.

The intermediate unit 20 includes a pair of columns 21L, 21R which extend in the vertical direction and which are opposed to and spaced apart from each other in the right-left direction. The optional unit 30 includes a pair of columns 31L, 31R which extend in the vertical direction and which are opposed to and spaced apart from each other in the right-left direction. The main body 10 includes a pair of columns 11L, 11R which extend in the vertical direction and which are opposed to and spaced apart from each other in the right-left direction. The columns 11L, 11R, the columns 21L, 21R, and the columns 31L, 31R are arranged in the vertical direction in this order from the bottom. The columns 11L, 11R are fixed to the housing 11, the columns 21L, 21R are fixed to the housing 21, and the columns 31L, 31R are fixed to the housing 31. Each of the columns 11L, 11R, 21L, 21R, 31L, 31R has an H-shaped cross section taken along a plane orthogonal to the vertical direction.

Figure 3A:
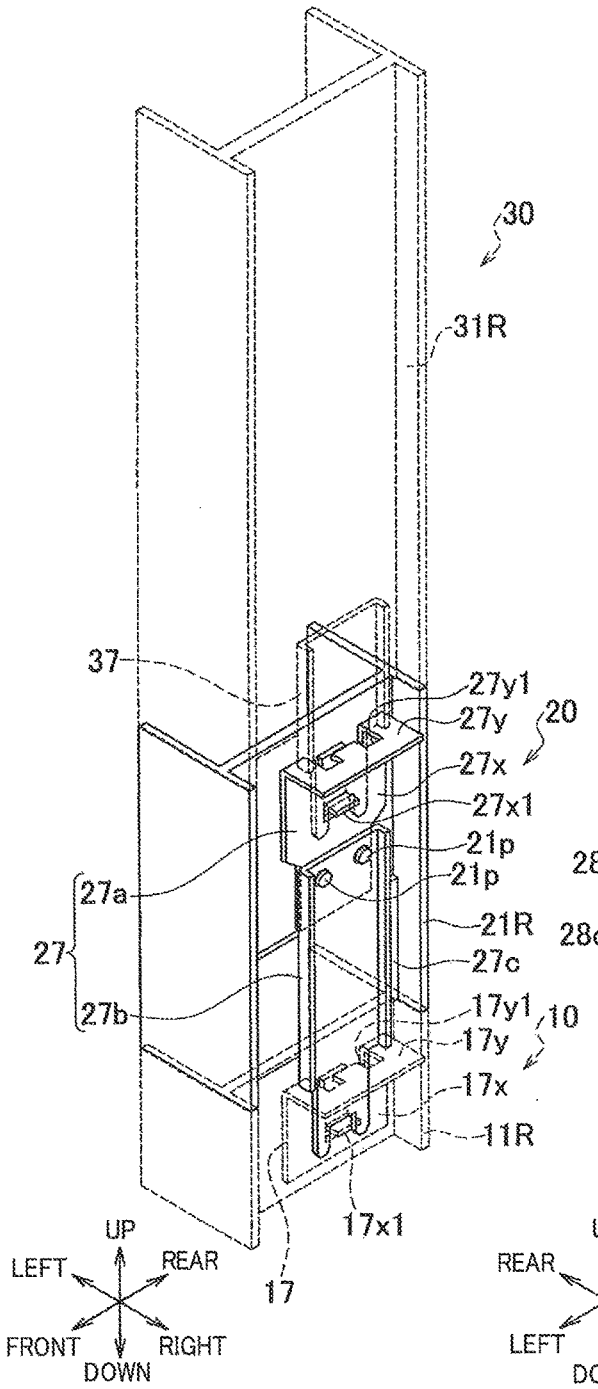
FIG. 3A is a perspective view showing an outer side of respective right-side columns of a main body, an intermediate unit, and the optional unit in the printer of the first embodiment

Metal members 17, 27, 37 are respectively attached to outer surfaces of the columns 11L, 11R, outer surfaces of the columns 21L, 21R, and outer surfaces of the columns 31L, 31R. Specifically, the metal member 17 is attached to the outer surface of each column 11L, 11R. While only the metal member 17 attached to the outer surface of the right-side column 11R is illustrated in FIG. 3A, the metal member 17 is similarly attached to the outer surface of the left-side column 11L. The metal member 27 is attached to the outer surface of each column 21L, 21R. While only the metal member 27 attached to the outer surface of the right-side column 21R is illustrated in FIG. 3A, the metal member 27 is similarly attached to the left-side column 21L. The metal member 37 is attached to the outer surface of each column 31L, 31R. While only the metal member 37 attached to the outer surface of the right-side column 31R is illustrated in FIG. 3A, the metal member 37 is similarly attached to the outer surface of the left-side column 31L. The metal member 17, 27, 37 of one unit functions as a connector by which the one unit is connected to another unit.

The metal member 17 functions as a connector of the main body 10 by which the main body 10 is connected to the intermediate unit 20 or the optional unit 30. The metal member 17 includes: a base portion 17*x* shaped like a plate and extending in the vertical direction; and a protruding portion 17*y* protruding from the base portion 17*x* outward of the column 11L, 11R in the right-left direction. The base portion 17*x* is provided with a protrusion 17*x*1 for positioning the intermediate unit 20 or the optional unit 30 with respect to the main body 10 in the vertical direction. The protruding portion 17*y* has a through-hole 17*y*1 into which an insertion portion 27*b* of the metal member 27 or the metal member 37 is insertable.

The metal member 37 shaped like a plate and extending in the vertical direction functions as a connector of the optional unit 30 by which the optional unit 30 is connected to the intermediate unit 20 or the main body 10.

The metal member 27 includes: a receiver portion 27*a* functioning as a connector of the intermediate unit 20 by which the intermediate unit 20 is connected to the optional unit 30; and the insertion portion 27*b* functioning as a connector of the intermediate unit 20 by which the intermediate unit 20 is connected to the main body 10.

The receiver portion 27*a* is similar to the metal member 17 in construction. That is, the receiver portion 27*a* includes: a base portion 27*x* shaped like a plate and extending in the vertical direction; and a protruding portion 27*y* protruding from the base portion 27*x* outward of the column 21L, 21R in the right-left direction. The base portion 27*x* is provided with a protrusion 27*x*1 for positioning the optional unit 30 with respect to the intermediate unit 20 in the vertical direction. The protruding portion 27*y* has a through-hole 27*y*1 into which the metal member 37 is insertable.

The insertion portion 27*b* is similar to the metal member 37 in construction. That is, the insertion portion 27*b* is shaped like a plate and extends in the vertical direction.

The receiver portion 27*a* is fixed to the column 21L, 21R such that a lower end of the base portion 27*x* is inserted onto a pair of protrusions 21*p* provided on the outer surface of the column 21L, 21R. The insertion portion 27*b* is fixed to the column 21L, 21R such that an upper end of the insertion portion 27*b* is inserted onto the pair of protrusions 21*p*. The receiver portion 27*a* and the insertion portion 27*b* are fixed relative to each other through the pair of protrusions 21*p*.

The base portion 27*x* of the receiver portion 27*a* is in contact with the outer surface of the column 21L, 21R. The insertion portion 27*b* is in contact with an outer surface of the lower end of the base portion 27*x* and an outer surface of a plate 27*c* which is fixed to the outer surface of the column 21L, 21R below the base portion 27*x*. Thus, a clearance is defined between the insertion portion 27*b* and the outer surface of the column 21L, 21R. The plate 27*c* has the same thickness as the base portion 27*x*. In other words, a projective region obtained by projecting the insertion portion 27*b* in the vertical direction onto the imaginary plane orthogonal to the vertical direction and a projective region obtained by projecting the base portion 27*x* of the receiver portion 27*a* in the vertical direction onto the imaginary plane do not coincide with each other but are adjacent to each other.

Like the insertion portion 27*b*, the metal member 37 is fixed to the outer surface of the column 31L, 31R via a plate (not shown) having the same thickness as the base portion 27*x*. Thus, a clearance is defined between the metal member 37 and the outer surface of the column 31L, 31R.

The base portion 17*x* and the protruding portion 17*y* of the metal member 17 are disposed so as to respectively align with the base portion 27*x* and the protruding portion 27*y* of the receiver portion 27*a* as seen in the vertical direction. The metal member 37 is disposed so as to align with the insertion portion 27*b* when viewed in the vertical direction. In other words, a projective region obtained by projecting, in the vertical direction, the insertion portion 27*b* functioning as the connector of the intermediate unit 20 connecting the intermediate unit 20 to the main body 10 onto the imaginary plane orthogonal to the vertical direction coincides with a projective region obtained by projecting, in the vertical direction, the metal member 37 functioning as the connector of the optional unit 30 connecting the optional unit 30 to the intermediate unit 20 onto the imaginary plane. Further, a projective region obtained by projecting, in the vertical direction, the receiver portion 27*a* functioning as the connector of the intermediate unit 20 connecting the intermediate unit 20 to the optional unit 30 onto the imaginary plane coincides with a projective region obtained by projecting, in the vertical direction, the metal member 17 functioning as the connector of the main body 10 connecting the main body 10 to the intermediate unit 20 onto the imaginary plane.

With the configurations of the metal members 17, 27, 37, the optional unit 30 is selectively mountable on one of the upper surface of the intermediate unit 20 and the upper surface of the main body 10.

In an inner space sandwiched by the pair of columns 21L, 21R and the pair of columns 31L, 31R in the right-left direction, there are disposed: the conveyance rollers 22, 32; a motor 38 (FIGS. 2 and 3B) for driving the conveyance rollers 22, 32; connectors 18, 28; cables 18*c*, 28*c*; gears for transmitting a drive force of the motor 38 to the conveyance rollers 22, 32; a solenoid 39*s* (FIGS. 4A and 4B) for moving the switcher 13*c*; and a transmission member 29*d*. While only the conveyance rollers 22 are illustrated in FIG. 2, the conveyance rollers 32 are disposed so as to align with the conveyance rollers 22 as seen in the vertical direction. While only one gear 23 is illustrated in FIG. 2, a plurality of gears are disposed. The transmission member 29*d* is connected to both of the switcher 13*c* and the solenoid 39*s* (as one example of "drive member") and is movable in the vertical direction so as to transmit a drive force of the solenoid 39*s* to the switcher 13*c*.

As shown in FIG. 2, a projective point G38 obtained by projecting a center of gravity of the motor 38 in the vertical direction onto the imaginary plane orthogonal to the vertical direction, a projective point G20 obtained by projecting a center of gravity of the intermediate unit 20 in the vertical direction onto the imaginary plane, and a projective point G obtained by projecting a center of gravity of a portion constituted by the intermediate unit 20 and the optional unit 30 in the vertical direction onto the imaginary plane are located within a projective region 11A obtained by projecting the housing 11 in the vertical direction onto the imaginary plane.

Figure 3B:
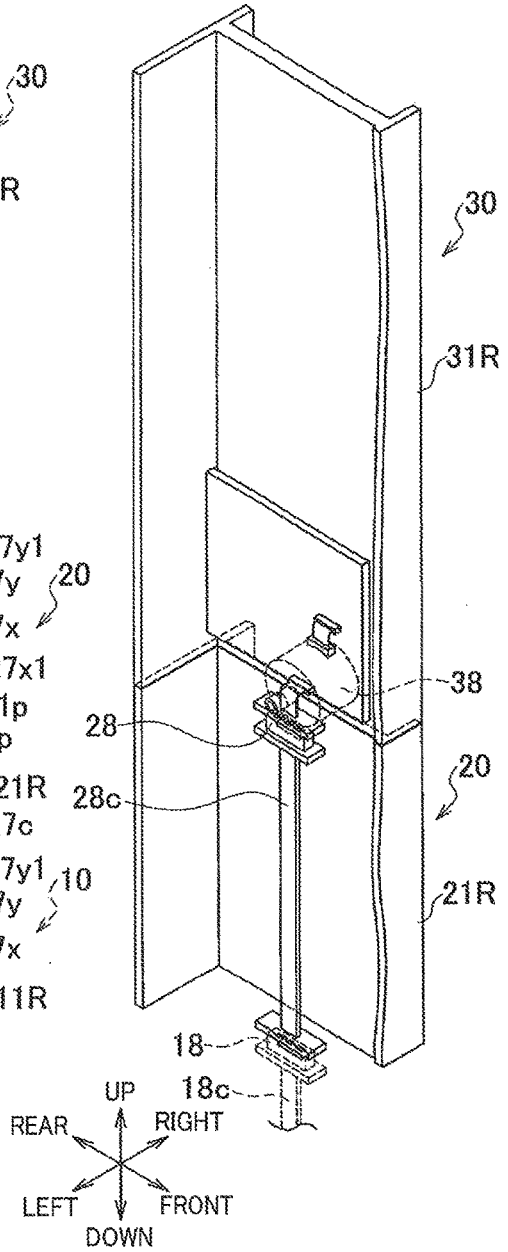
FIG. 3B is a perspective view showing an inner side of the right-side columns of the intermediate unit and the optional unit in the printer of the first embodiment.

As shown in FIG. 3B, the motor 38 is attached to a lower end of an inner surface of the column 31R. The connector 28 is attached to an upper end of an inner surface of the column 21R. When the optional unit 30 is mounted on the intermediate unit 20, the connector 28 is connected to terminals of the motor 38. The cable 28*c* extends downward from the connector 28 along the inner surface of the column 21R. The connector 18 is attached to an upper end of an inner surface of the column 11R. When the intermediate unit 20 is mounted on the main body 10, the connector 18 is connected to a lower end of the cable 28*c*. When the optional unit 30 is mounted on the main body 10, the connector 18 is connected to the terminals of the motor 38. The cable 18*c* extends downward from the connector 18 along the inner surface of the column 11R so as to be connected to the controller 16.

Figure 4A:
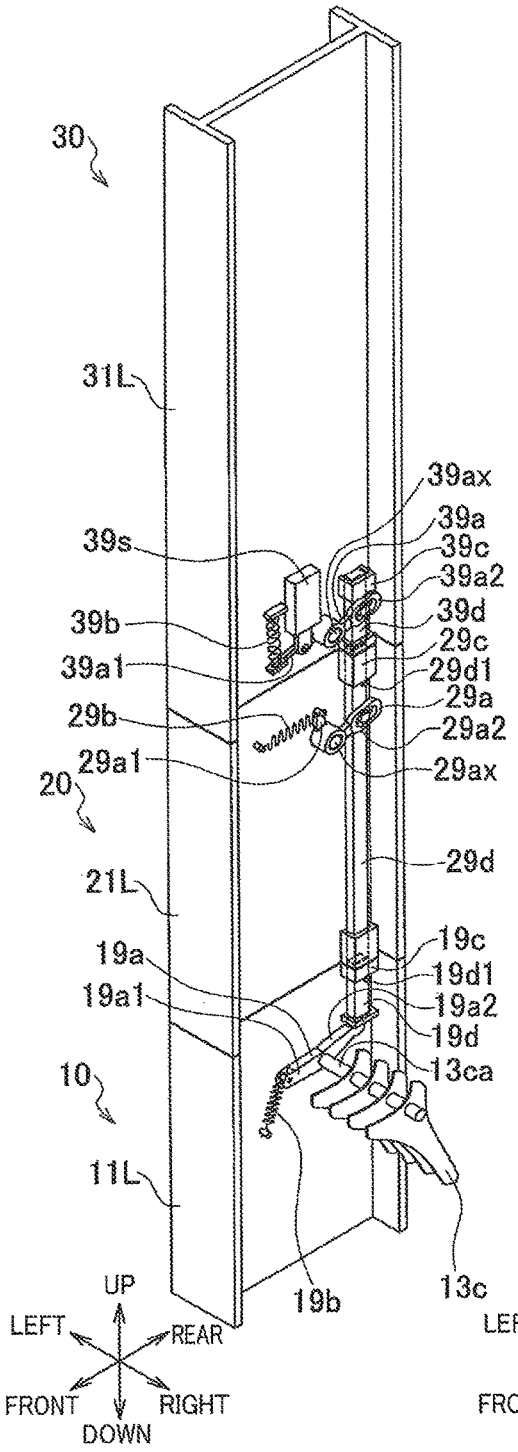
FIGS. 4A and 4B are perspective views showing an inner side of respective left-side columns of the main body, the intermediate unit, and the optional unit in the printer of the first embodiment, FIG. 4A showing a state in which a switcher is located at a position at which the switcher permits a sheet to be conveyed to a receiving tray of the main body, FIG. 4B showing a state in which the switcher is located at a position at which the switcher permits the sheet to be conveyed to a discharge opening of the main body.
Figure 4B:
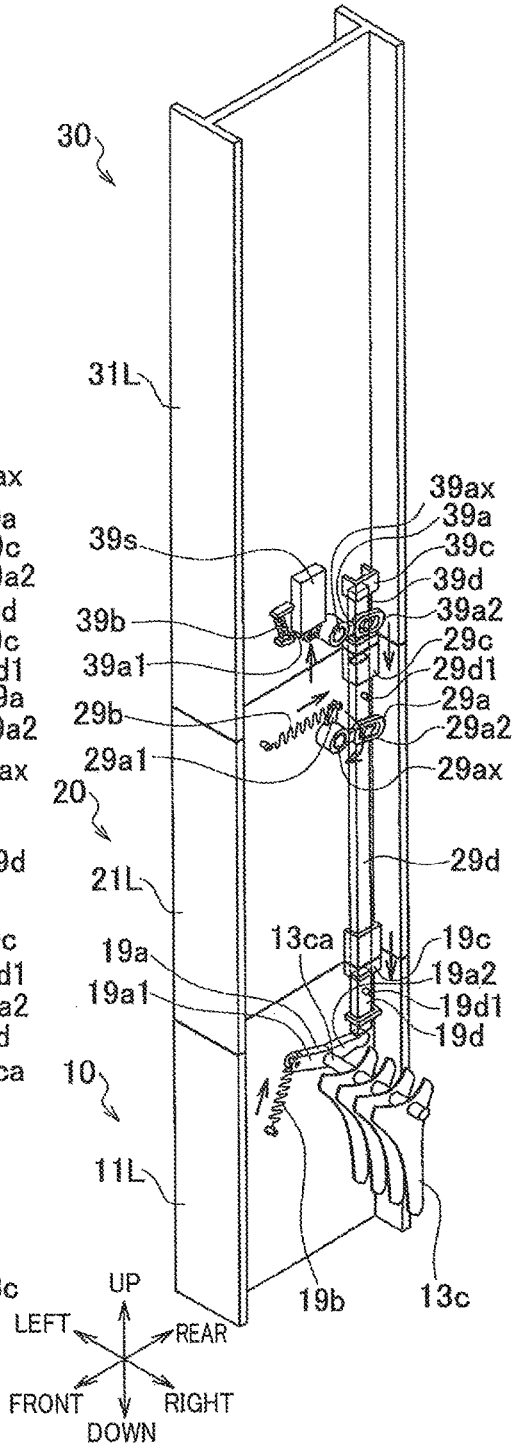

As shown in FIGS. 4A and 4B, the solenoid 39*s* is attached to a lower end of an inner surface of the column 31L. At the lower end of the inner surface of the column 31L, there are provided: a pivot member 39*a* pivotable about a shaft 39*ax* that extends in the right-left direction; a spring 39*b* contacting a distal end of an arm 39*a*1 which is one of two arms of the pivot member 39*a*; a transmission member 39*d* engaging with an arm 39*a*2 which is the other of the two arms of the pivot member 39*a*; and a stopper 39*c*. The arm 39*a*1 is held in engagement with a plunger of the solenoid 39*s*. The transmission member 39*d* extends in the vertical direction and comes into contact with an upper end of the transmission member 29*d* when the optional unit 30 is mounted on the intermediate unit 20. The spring 39*b* biases the pivot member 39*a* in a direction in which the transmission member 39*d* moves upward. The stopper 39*c* limits an upward movement of the transmission member 39*d* when it comes into contact with the arm 39*a*2.

The transmission member 29*d* is attached to the inner surface of the column 21L and extends in the vertical direction along the inner surface. The transmission member 29*d* has the same length in the vertical direction as the column 21L. On the inner surface of the column 21L, there are provided: a pivot member 29*a* pivotable about a shaft 29*ax* that extends in the right-left direction; a spring 29*b* contacting a distal end of an arm 29*a*1 which is one of two arms of the pivot member 29*a*; and a stopper 29*c*. An arm 29*a*2, which is the other of the two arms of the pivot member 29*a*, is held in engagement with the transmission member 29*d*. The spring 29*b* biases the pivot member 29*a* in a direction in which the transmission member 29*d* moves upward. The stopper 29*c* limits an upward movement of the transmission member 29*d* when it comes into contact with a protrusion 29*d*1 formed on the surface of the transmission member 29*d*.

The switcher 13*c* is attached to an upper end of the inner surface of the column 11L. At the upper end of the inner surface of the column 11L, there are provided: a pivot member 19*a* pivotable about the shaft 13*ca*; a spring 19*b* contacting a distal end of an arm 19*a*1 which is one of two arms of the pivot member 19*a*; a transmission member 19*d* contacting an upper end of an arm 19*a*2 which is the other of the two arms of the pivot member 19*a*; and a stopper 19*c*. The pivot member 19*a* is fixed to a proximal end of the shaft 13*ca* and is configured to pivot so as to rotate the shaft 13*ca* for thereby pivoting the switcher 13*c*. The transmission member 19*d* extends in the vertical direction. When the intermediate unit 20 is mounted on the main body 10, the transmission member 19*d* comes into contact with a lower end of the transmission member 29*d*. When the optional unit 30 is mounted on the main body 10, the transmission member 19*d* comes into contact with a lower end of the transmission member 39*d*. The spring 19*b* biases the pivot member 19*a* in a direction in which the transmission member 19*d* moves upward. The stopper 19*c* limits an upward movement of the transmission member 19*d* when it comes into contact with a protrusion 19*d*1 formed on the surface of the transmission member 19*d*.

When the solenoid 39*s* is not driven, namely, when the transmission member 29*d* does not transmit the drive force of the solenoid 39*s* to the switcher 13*c*, the components described above are in a state shown in FIG. 4A. In this state, the lower end of the transmission member 39*d* is located at the same height level as the lower end of the column 31L. Thus, the transmission member 39*d* does not protrude downward from the lower surface 31*a* of the housing 31. The upper end of the transmission member 29*d* is located at the same height level as the upper end of the column 21L while the lower end of the transmission member 29*d* is located at the same height level as the lower end of the column 21L. Thus, the transmission member 29*d* does not protrude downward from the lower surface 21*b* of the housing 21. The upper end of the transmission ember 19*d* is located at the same height level as the upper end of the column 11L. Thus, the transmission member 19*d* is not retracted downward from the upper surface 11*a* of the housing 11.

When the solenoid 39*s* is driven, namely, when the transmission member 29*d* transmits the drive force of the solenoid 39*s* to the switcher 13*c*, the state of the components described above is changed to a state shown in FIG. 4B. Specifically, the plunger of the solenoid 39*s* contracts, so that the pivot member 39*a* pivots against the biasing force of the spring 39*b* and the transmission member 39*d* moves downward. As a result, the transmission member 29*d* moves downward by being pushed down by the transmission member 39*d*, and the transmission member 19*d* moves downward by being pushed down by the transmission member 29*d*. In this instance, the downward movement of the transmission member 29*d* causes the pivot member 29*a* to pivot against the biasing force of the spring 29*b*, and the downward movement of the transmission member 19*d* causes the pivot member 19*a* to pivot against the biasing force of the spring 19*b*. As a result, the switcher 13*c* moves from the position (FIG. 4A) at which the switcher 13*c* permits the sheet to be conveyed to the receiving tray 15 to the position (FIG. 4B) at which the switcher 13*c* permits the sheet to be conveyed to the discharge opening 11*x*. In this instance, the lower end of the transmission member 39*d* is located at a height level lower than the lower end of the column 31L. Thus, the transmission member 39*d* protrudes downward from the lower surface 31*a* of the housing 31. The lower end of the transmission member 29*d* is located at a height level lower than the lower end of the column 21L. Thus, the transmission member 39*d* protrudes downward from the lower surface 21*b* of the housing 21. The upper end of the transmission member 19*d* is located at a height level lower than the upper end of the column 11L. Thus, the transmission member 19*d* is retracted downward from the upper surface 11*a* of the housing 11.

The present embodiment employs the configuration shown in FIG. 1 in which the intermediate unit 20 is mounted on the upper portion of the main body 10 and the optional unit 30 is mounted on the upper portion of the intermediate unit 20, instead of employing the configuration in which the intermediate unit 20 is mounted on one side of the main body 10 and the optional unit 30 is mounted on the upper portion of the intermediate unit 20. The configuration according to the present embodiment prevents the footprint of the printer 1 as a whole on the horizontal plane from increasing and also prevents the printer 1 from toppling over. Further, the length H20 of the intermediate unit 20 in the height direction is made smaller than the length H30 of the optional unit 30 in the height direction, whereby the posture of the printer 1 as a whole is stabilized, so as to more effectively prevent the printer 1 from toppling over. Thus, the present embodiment prevents, in the configuration in which the optional unit 30 is mounted on the main body 10 via the intermediate unit 20, the footprint of the printer 1 as a whole on the horizontal plane from increasing and also prevents the printer 1 from toppling over.

The optional unit 30 includes the motor 38 (FIG. 3B) for driving the conveyance rollers 22 provided in the intermediate unit 20. In this arrangement, the motor is provided in the optional unit 30 which is not required to be developed for various types of the main body 10 while the motor is not provided in the intermediate unit 20 which is required to be developed for the respective types of the main body 10, thereby reducing a production cost of the intermediate unit 20 and reducing the cost of developing the printer 1 as a whole.

As shown in FIG. 2, the projective point G38 obtained by projecting the center of gravity of the motor 38 in the vertical direction onto the imaginary plane orthogonal to the vertical direction is located within the projective region 11A obtained by projecting the housing 11 in the vertical direction onto the imaginary plane. This arrangement prevents the printer 1 from toppling over with high reliability.

As shown in FIG. 2, the projective point G obtained by projecting the center of gravity of the portion constituted by the intermediate unit 20 and the optional unit 30 in the vertical direction onto the imaginary plane is located within the projective region 11A described above. This arrangement prevents the printer 1 from toppling over with high reliability.

As shown in FIG. 2, the projective point G20 obtained by projecting the center of gravity of the intermediate unit 20 in the vertical direction onto the imaginary plane is located within the projecting region 11A described above. This arrangement prevents the printer 1 from toppling over with high reliability.

As shown in FIG. 3A, the insertion portion 27*b* functioning as the connector of the intermediate unit 20 connecting the intermediate unit 20 to the main body 10 is identical in construction with the metal member 37 functioning as the connector of the optional unit 30 connecting the optional unit 30 to the intermediate unit 20. The receiver portion 27*a* functioning as the connector of the intermediate unit 20 connecting the intermediate unit 20 to the optional unit 30 is identical in construction with the metal member 17 functioning as the connector of the main body 10 connecting the main body 10 to the intermediate unit 20. The optional unit 30 is removably mountable not only on the upper surface of the intermediate unit 20 bus also on the upper surface of the main body 10. Thus, the user can suitably select one of mounting the optional unit 30 on the main body 10 via the intermediate unit 20 and mounting the optional unit 30 directly on the main body 10.

As shown in FIG. 3A, the projective region obtained by projecting, in the vertical direction, the insertion portion 27*b* functioning as the connector of the intermediate unit 20 connecting the intermediate unit 20 to the main body 10 onto the imaginary plane orthogonal to the vertical direction coincides with the projective region obtained by projecting, in the vertical direction, the metal member 37 functioning as the connector of the optional unit 30 connecting the optional unit 30 to the intermediate unit 20 onto the imaginary plane. Further, the projective region obtained by projecting, in the vertical direction, the receiver portion 27*a* functioning as the connector of the intermediate unit 20 connecting the intermediate unit 20 to the optional unit 30 onto the imaginary plane coincides with the projective region obtained by projecting, in the vertical direction, the metal member 17 functioning as the connector of the main body 10 connecting the main body 10 to the intermediate unit 20 onto the imaginary plane. This arrangement reliably achieves the configuration indicated above in which the optional unit 30 is removably mountable selectively on one of the upper surface of the intermediate unit 20 and the upper surface of the main body 10.

The insertion portion 27*b*, functioning as the connector of the intermediate unit 20 by which the intermediate unit 20 is connected to the main body 10, is shaped like a plate and extending in the vertical direction, as shown in FIG. 3A. The receiver portion 27*a*, functioning as the connector of the intermediate unit 20 by which the intermediate unit 20 is connected to the optional unit 30, includes: a base portion 27*x* shaped like a plate and extending in the vertical direction; and a protruding portion 27*y* protruding from the base portion 27*x* outward of the column 21L, 21R in the right-left direction and having a through-hole 27*y*1 into which the metal member 37 is insertable. The projective region obtained by projecting the insertion portion 27*b* in the vertical direction onto the imaginary plane orthogonal to the vertical direction and the projective region obtained by projecting the base portion 27*x* of the receiver portion 27*a* in the vertical direction onto the imaginary plane do not coincide with each other but are adjacent to each other. This arrangement achieves the configuration indicated above in which the optional unit 30 is removably mountable selectively on one of the upper surface of the intermediate unit 20 and the upper surface of the main body 10 with a comparatively simple structure.

In an inner space sandwiched by the pair of columns 21L, 21R and the pair of columns 31L, 31R in the right-left direction, there are disposed the motor 38 and the gears (as one example of "transmission mechanism") for transmitting the drive force of the motor 38 to the conveyance rollers 22, as shown in FIG. 2. In this arrangement, the motor and the transmission mechanism having certain weights are disposed in the inner space defined between the pair of columns 21L, 21R and the pair of columns 31L, 31R, so that the posture of the printer 1 as a whole is stabilized. It is thus possible to reliably prevent the printer 1 from toppling over.

As shown in FIG. 2, the conveyance rollers 22 are disposed in the inner space sandwiched by the pair of columns 21L, 21R and the pair of columns 31L, 31R in the right-left direction. In this arrangement, the drive force of the motor 38 can be transmitted to the conveyance rollers 22 through the transmission mechanism with a comparatively simple structure.

As shown in FIGS. 2 and 3A, the metal member 27 (including the insertion portion 27*b* as the connector of the intermediate unit 20 connecting the intermediate unit 20 to the main body 10 and the receiver portion 27*a* as the connector of the intermediate unit 20 connecting the intermediate unit 20 to the optional unit 30) is disposed in each of outer spaces located outside the pair of columns 21L, 21R in the right-left direction, and the metal member 37 as the connector of the optional unit 30 connecting the optional unit 30 to the intermediate unit 20 is disposed in each of outer spaces located outside the pair of columns 31L, 31R in the right-left direction. That is, the metal member 27 is not fixed to an inner surface of each of the columns 21L, 21R which are opposed to each other in the right-left direction. The right-side metal member 27 is fixed to the outer surface of the right-side column 21R, and the left-side metal member 27 is fixed to the outer surface of the left-side column 21L. Similarly, the metal member 37 is not fixed to an inner surface of each of the columns 31L, 31R which are opposed to each other in the right-left direction. The right-side metal member 37 is fixed to the outer surface of the right-side column 31R, and the left-side metal member 37 is fixed to the outer surface of the left-side column 31L. In this arrangement, the connectors are disposed in the respective outer spaces located outside the columns 21L, 21R and the columns 31L, 31R, so that the posture of the printer 1 as a whole is stabilized. It is thus possible to reliably prevent the printer 1 from toppling over.

When the transmission member 29*d* transmits the drive force of the solenoid 39*s* to the switcher 13*c*, the transmission member 29*d* protrudes downward from the lower surface 21*b* of the housing 21 (FIG. 4B). On the other hand, when the transmission member 29*d* does not transmit the drive force of the solenoid 39*s* to the switcher 13*c*, the transmission member 29*d* does not protrude downward from the lower surface 21*b* of the housing 21 (FIG. 4A). In mounting the intermediate unit 20 on the main body 10, the printer 1 is in a situation in which the drive force of the solenoid 39*s* is not transmitted to the switcher 13*c*. Accordingly, the transmission member 29*d* does not protrude downward from the lower surface 21*b* of the housing 21 of the intermediate unit 20. Thus, the transmission member 29*d* does not hinder mounting of the intermediate unit 20 on the main body 10.

Second Embodiment

Figure 5:
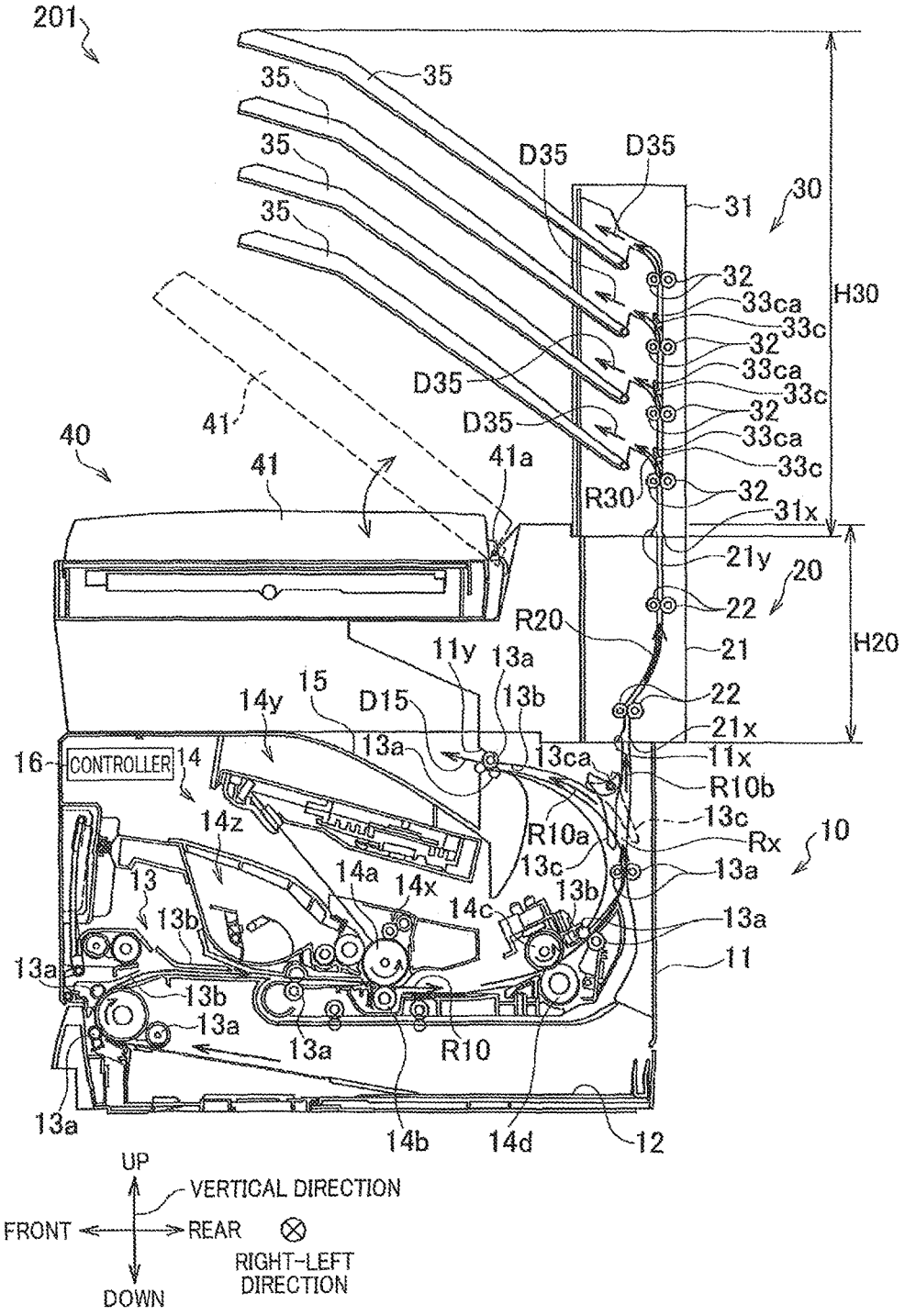
FIG. 5 is a schematic view of a printer according to a second embodiment.

Referring next to FIG. 5, there will be described a second embodiment.

A printer 201 of the second embodiment and the printer 1 of the first embodiment are different in the following configuration and are identical in the other configuration. That is, the printer 201 differs from the printer 1 in the shape of the path R20 of the intermediate unit 20, the positional relationship between the introduction opening 21*x* and the discharge opening 21*y*, and the location of the optional unit 30.

In the present embodiment, the discharge opening 21*y* is located upstream of the introduction opening 21*x* in the movement direction D15, D35. With this configuration, the path R20 is curved instead of linearly extending in the vertical direction, and the receiving trays 35 of the optional unit 30 are located on the more upstream side in the movement direction D15, D35, as compared with the first embodiment.

The second embodiment described above offers the same advantages as those offered by the first embodiment according to the same configuration as employed in the first embodiment.

In the present embodiment, the discharge opening 21*y* is located upstream of the introduction opening 21*x* in the movement direction D35, whereby the receiving trays 35 can be disposed on the more upstream side in the movement direction D35, as compared with the first embodiment in which the discharge opening 21*y* and the introduction opening 21*x* align with each other in the vertical direction. It is thus possible to effectively utilize a space existing downstream of the receiving trays 35 in the movement direction D35.

There may arise a risk that the cover 41 disposed below the receiving trays 35 will come into contact with the lowermost receiving tray 35 when the cover 41 is opened and closed. In the present embodiment, the receiving trays 35 are disposed on the upstream side in the movement direction D35 as described above, obviating the risk.

Third Embodiment

Figure 6:
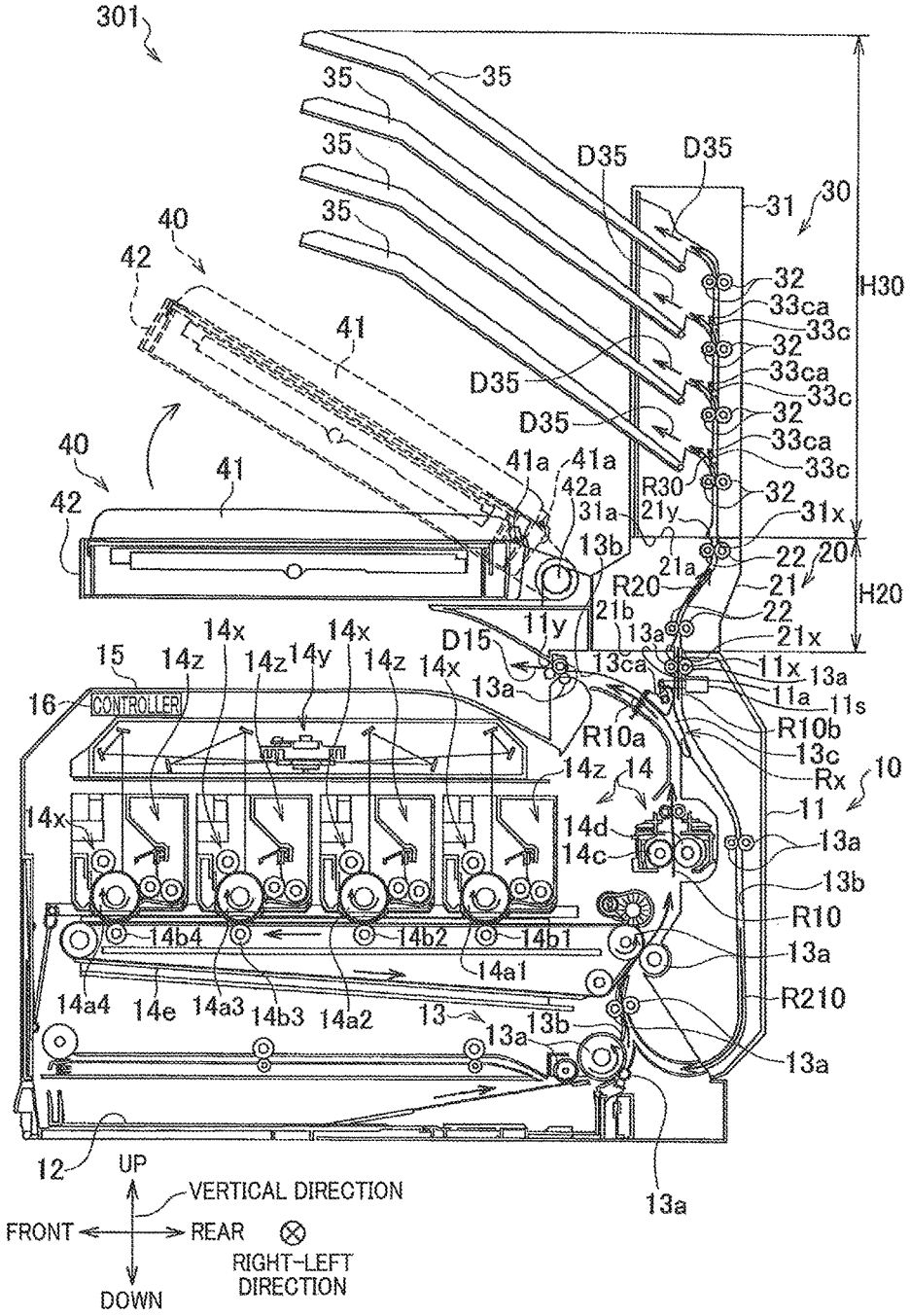
FIG. 6 is a schematic view of a printer according to a third embodiment.

Referring next to FIG. 6, there will be described a third embodiment.

A printer 301 of the third embodiment is similar to the printer 201 of the second embodiment but differs from the printer 201 in that: the scanner unit 40 is disposed not on the upper surface of the intermediate unit 20 but on the upper surface of the main body 10; the scanner unit 40 which is configured such that the cover 41 is openable about the shaft 41*a* is also configured such that a housing 42 of the scanner unit 40 is disposed below the receiving trays 35 and is openable about a shaft 42*a* located on the upstream side in the movement direction D15 so as to extend in the right-left direction (which is orthogonal to the movement direction D15 and the vertical direction); a solenoid 11*s* for moving the switcher 13*c* is provided in the main body 10; the image former 14 includes four photoconductive drums 14*a*1-14*a*4 corresponding to respective four colors (CMYK) and the printer 301 is a color printer; and the printer 301 includes a path used for duplex printing.

In the present embodiment, a path R210 is formed in the housing 11, in addition to the path R10. The path R210 is for conveying, again to the image former 14, the sheet having the image formed on its first surface.

The image former 14 includes: the four photoconductive drums 14*a*1-14*a*4; four transfer rollers 14*b*1-14*b*4; four charging units 14*x*; the laser unit 14*y*; four toner units 14*z*; the fixing roller 14*c*; the pressure roller 14*d*; and an intermediate transfer belt 14*e*. The intermediate transfer belt 14*e* is in contact with a portion of the path R10 on the upstream side of the branch position Rx in the path R10. Each of the photoconductive drums 14*a*1-14*a*4 forms a pair with a corresponding one of the transfer rollers 14*b*1-14*b*4. Each photoconductive drum 14*a*1-14*a*4 and each transfer roller 14*b*1-14*b*4 that form a pair are opposed to each other with the intermediate transfer belt 14*e* interposed therebetween. The four pairs are arranged in a running direction of the intermediate transfer belt 14*e*. The fixing roller 14*c* and the pressure roller 14*d* are in contact with each other with the path R10 interposed therebetween on the upstream side of the branch position Rx in the path R10 and on the downstream side of the intermediate transfer belt 14*e*.

The surfaces of the photoconductive drums 14*a*1-14*a*4 are charged by the respective charging units 14*x* and are irradiated with a laser light emitted from the laser unit 14*y*, so that electrostatic latent images are formed on the respective surfaces. Subsequently, toner is supplied to the surfaces from the respective toner units 14*z* so as to form toner images thereon. The transfer rollers 14*b*1-14*b*4, to which is applied a voltage opposite to a voltage applied to the photoconductive drums 14*a*1-14*a*4, transfer the toner images onto an outer surface of the intermediate transfer belt 14*e*. Thereafter, the toner images are transferred from the outer surface of the intermediate transfer belt 14*e* to the sheet, and toner is fixed on the sheet by the heat of the fixing roller 14*c* and the pressure of the fixing roller 14*c* and the pressure roller 14*d*. Thus, a color image is formed on the sheet by the image former 14.

The switcher 13*c* is movable so as to be selectively located at: a position at which the switcher 13*c* permits the sheet to be conveyed to the receiving tray 15; a position at which the switcher 13*c* permits the sheet to be conveyed to the discharge opening 11*x*; and a position at which the switcher 13*c* permits the sheet, which has been conveyed to the path R20 and the conveyance direction has been reversed, to be guided to the path R210.

When the controller 16 receives a command of single-sided printing, the controller 16 controls the conveyor mechanism 13 and the image former 14 to convey the sheet and form an image as described below.

The sheet having an image formed on the first surface by the image former 14 is conveyed along the path R10*a* and received by the receiving tray 15. Alternatively, the sheet having an image formed on the first surface by the image former 14 is conveyed along the path R10*b*, subsequently conveyed to the paths R20, R30 via the discharge opening 11*x* and the introduction opening 21*x*, and finally discharged onto one of the four receiving trays 35.

When the controller 16 receives a command of duplex printing, the controller 16 controls the conveyor mechanism 13 and the image former 14 to convey the sheet and form an image as described below.

The sheet having an image formed on the first surface by the image former 14 is conveyed along the path R10*b* and is subsequently conveyed to the path R20 via the discharge opening 11*x* and the introduction opening 21*x*. The conveyance direction of the sheet is reversed at timing when its trailing end is located in the path R10*b* on the downstream side of the branch position Rx. Thereafter, the switcher 13*c* is placed at the position at which the switcher 13*c* permits the sheet to be conveyed to the path R210, so that the sheet is conveyed again to the image former 14 along the path R210. After the image former 14 forms an image on a second surface of the sheet opposite to the first surface, the sheet is received by the receiving tray 15 or by one of the four receiving trays 35.

The third embodiment described above offers the same advantages as those offered by the second embodiment according to the same configuration as employed in the second embodiment. There may arise a risk that the cover 41 or the housing 42 disposed below the receiving trays 35 will come into contact with the lowermost receiving tray 35 when the cover 41 or the housing 42 is opened and closed.

In the present embodiment, the receiving trays 35 are disposed on the upstream side in the movement direction D35 as described above, obviating the risk.

Fourth Embodiment

Figure 7:
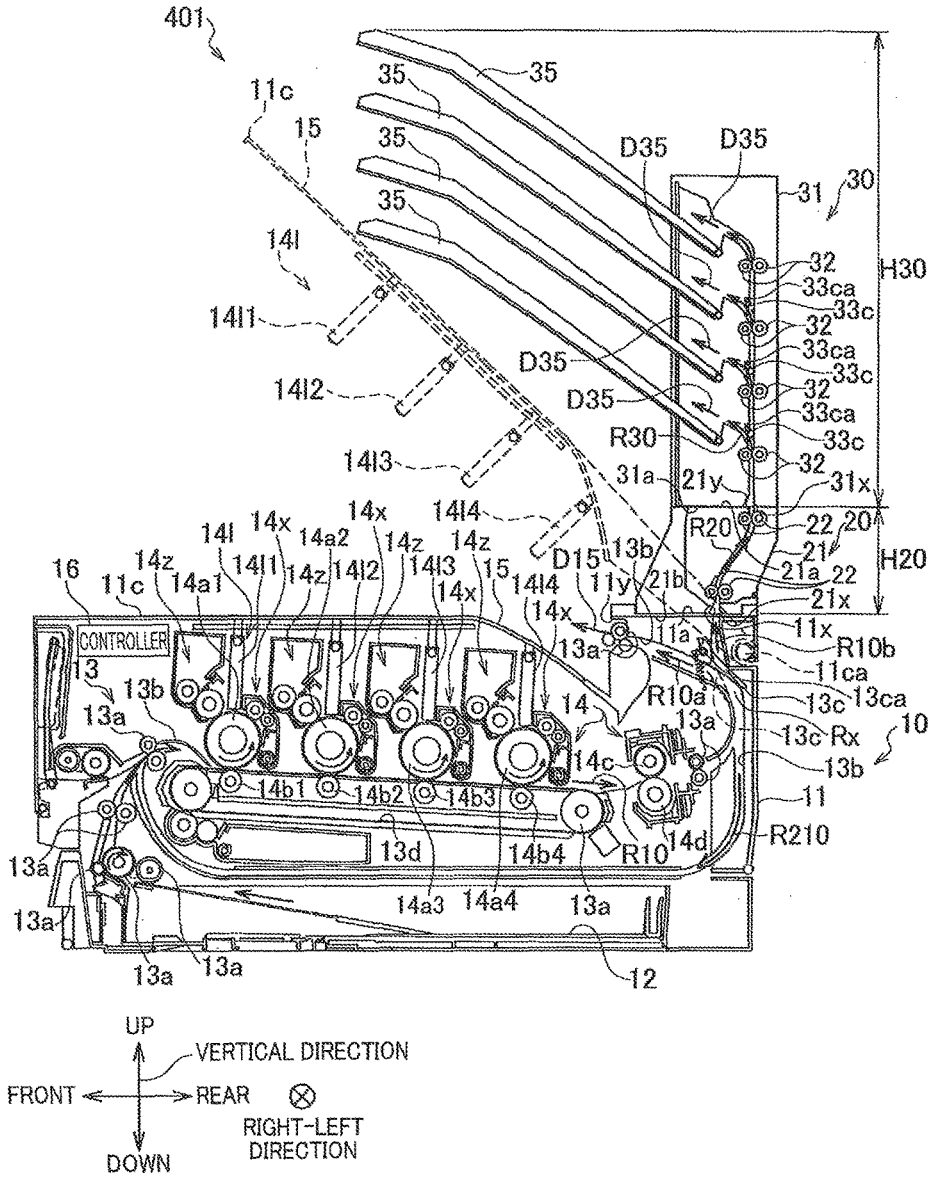
FIG. 7 is a schematic view of a printer according to a fourth embodiment.

Referring next to FIG. 7, there will be described a fourth embodiment.

A printer 401 of the fourth embodiment is similar to the printer 301 of the third embodiment but differs from the printer 301 in that: the scanner unit 40 is not provided and an upper cover 11*c* of the housing 11 is openable instead of the scanner unit 40; the image former 14 has a different structure, namely, the printer 401 is an LED printer including light sources 14*l*1-14*l*4 of light emitting diodes (LED); and the structure of the conveyor mechanism 13 is different.

The conveyor mechanism 13 includes a loop-like conveyor belt 13*d* in addition to the conveyance rollers 13*a*, the guide 13*b*, and the switcher 13*c*. The conveyor belt 13*d* conveys the sheet while supporting the sheet below the four photoconductive drums 14*a*1-14*a*4.

The image former 14 includes the four photoconductive drums 14*a*1-14*a*4, the four transfer rollers 14*b*1-14*b*4, the four charging units 14*x*, an LED unit 141, the four toner units 14*z*, the fixing roller 14*c*, and the pressure roller 14*d*. The LED unit 141 includes four light sources 14*l*1-14*l*4. Each of the photoconductive drums 14*a*1-14*a*4 forms a pair with a corresponding one of the transfer rollers 14*b*1-14*b*4. Each photoconductive drum 14*a*1-14*a*4 and each transfer roller 14*b*1-14*b*4 that form a pair are opposed to each other with the conveyor belt 13*d* interposed therebetween. The four pairs are arranged in the running direction of the conveyor belt 13*d*. The fixing roller 14*c* and the pressure roller 14*d* are in contact with each other with the path R10 interposed therebetween on the upstream side of the branch position Rx in the path R10 and on the downstream side of the conveyor belt 13*d*.

The surfaces of the photoconductive drums 14*a*1-14*a*4 are charged by the respective charging units 14*x* and are irradiated with LED lights emitted respectively from the light sources 14*l*1-14*l*4 of the LED unit 141, so as to form electrostatic latent images. Subsequently, toner is supplied to the surfaces from the respective toner units 14*z*, so as to form toner images. The transfer rollers 14*b*1-14*b*4, to which is applied a voltage opposite to a voltage applied to the photoconductive drums 14*a*1-14*a*4, transfer the toner images onto the sheet conveyed by the conveyor belt 13*d* while being supported, and toner is fixed on the sheet by the heat of the fixing roller 14*c* and the pressure of the fixing roller 14*c* and the pressure roller 14*d*. Thus, a color image is formed on the sheet by the image former 14.

The upper surface of the upper cover 11*c* functions as the receiving tray 15. The upper cover 11*c* is disposed below the receiving trays 35. The upper cover 11*c* is openable about a shaft 11*ca* located on the upstream side in the movement direction D15 so as to extend in the right-left direction (which is orthogonal to the movement direction D15 and the vertical direction). The upper cover 11*c* is opened and closed in replacement of the toner units 14*z*, in a jam clearing operation, and the like.

The fourth embodiment described above offers the same advantages as those offered by the third embodiment according to the same configuration as employed in the third embodiment. There may arise a risk that the upper cover 11*c* disposed below the receiving trays 35 will come into contact with the lowermost receiving tray 35 when the upper cove 11*c* is opened and closed. In the present embodiment, the receiving trays 35 are disposed on the upstream side in the movement direction D35 as described above, obviating the risk.

Fifth Embodiment

Figure 8:
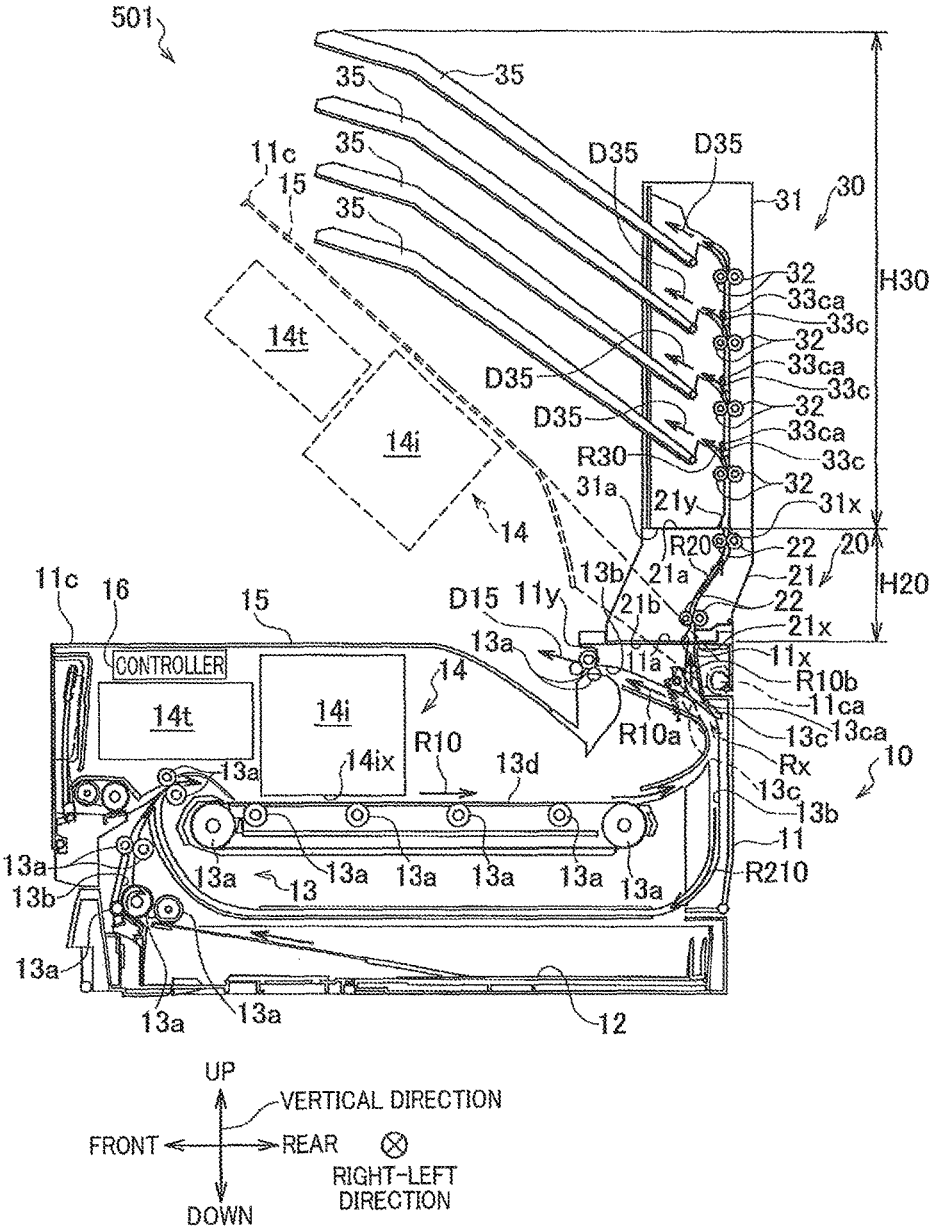
FIG. 8 is a schematic view of a printer according to a fifth embodiment.

Referring next to FIG. 8, there will be described a fifth embodiment.

A printer 501 of the fifth embodiment is similar to the printer 401 of the fourth embodiment but differs from the printer 401 in the structure of the image former 14, namely, the printer 501 is a line ink-jet printer having a line ink-jet head 14*i*.

The image former 14 includes the ink-jet head 14*i* and an ink tank 14*t*. The ink-jet head 14*i* is held in communication with the ink tank 14*t*. There are formed, in the ink-jet head 14*i*, a reservoir for storing ink supplied from the ink tank 14*t* and ink passages which branch off from the reservoir toward a plurality of ejection openings. The ejection openings are open to a lower surface 14*ix* of the ink-jet head 14*i*. A predetermined spacing is formed between the lower surface 14*ix* of the ink-jet head 14*i* and the upper surface of the conveyor belt 13*d*.

Ink is ejected selectively from the ejection openings of the ink-jet head 14*i* to the sheet conveyed by the conveyor belt 13*d* while being supported, so that ink is attached onto the sheet. Thus, the image former 14 forms an image on the sheet.

The fifth embodiment described above offers the same advantages as those offered by the fourth embodiment according to the same configuration as employed in the fourth embodiment.

Sixth Embodiment

Figure 9A:
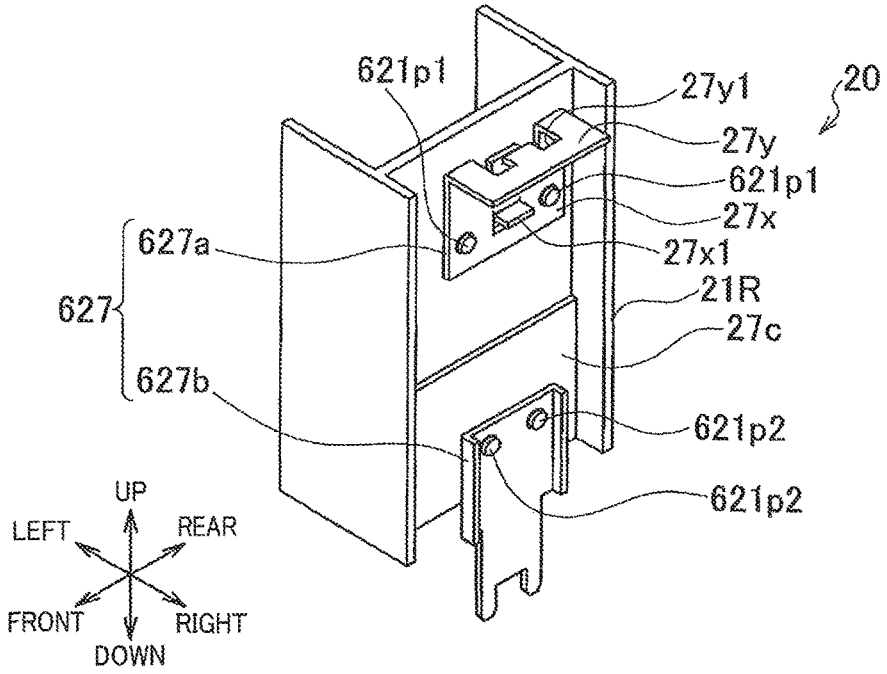
FIG. 9A is a perspective view showing an outer side of a right-side column of an intermediate unit of a printer according to a sixth embodiment and FIG. 9B is a perspective view of a right-side column of an intermediate unit of a printer according to a seventh embodiment.

Referring next to FIG. 9A, there will be described a sixth embodiment.

A printer of the sixth embodiment and the printer 1 of the first embodiment are different in the structure of the metal member of the intermediate unit 20 and are identical in the other configuration.

In the sixth embodiment, a metal member 627 of the intermediate unit 20 includes a receiver portion 627*a* and an insertion portion 627*b* which are not fixed relative to each other but are separated away from each other. The receiver portion 627*a* and the insertion portion 627*b* are fixed to the column 21L, 21R independently of each other. The receiver portion 627*a* is fixed to the column 21L, 21R such that the lower end of the base portion 27*x* is inserted onto a pair of protrusions 621*p*1 provided on the outer surface of the column 21L, 21R. The insertion portion 627*b* is fixed to the column 21L, 21R such that its upper end is inserted onto a pair of protrusions 621*p*2 provided on the outer surface of the plate 27*c*.

The base portion 27*x* of the receiver portion 627*a* is in contact with the outer surface of the column 21L, 21R. The insertion portion 627*b* is in contact with the outer surface of the plate 27*c*. Also in the present embodiment, a projective region obtained by projecting the insertion portion 627*b* in the vertical direction onto the imaginary plane orthogonal to the vertical direction and a projective region obtained by projecting the base portion 27*x* of the receiver portion 627*a* in the vertical direction onto the imaginary plane do not coincide with each other but are adjacent to each other.

The sixth embodiment described above offers the same advantages as those offered by the first embodiment according to the same configuration as employed in the first embodiment. Further, the metal member of the intermediate unit 20 has a smaller size as compared with that in the first embodiment, resulting in a reduced cost for the metal member of the intermediate unit 20.

Seventh Embodiment

Figure 9B:
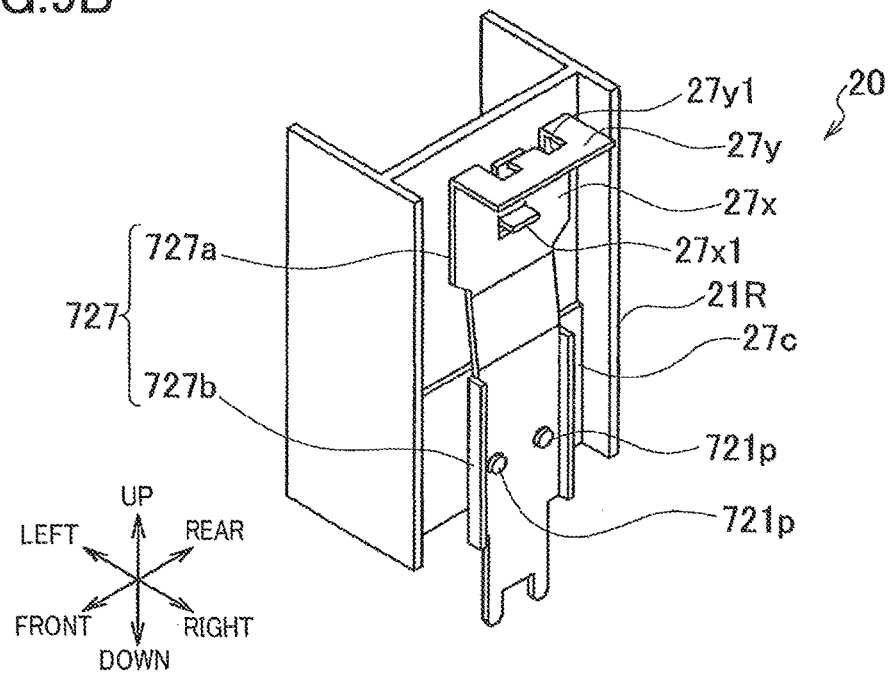

Referring next to FIG. 9B, there will be described a seventh embodiment.

A printer of the seventh embodiment and the printer 1 of the first embodiment are different in the structure of the metal member of the intermediate unit 20 and are identical in the other configuration.

In the seventh embodiment, a metal member 727 of the intermediate unit 20 includes a receiver portion 727*a* and an insertion portion 727*b* formed integrally with each other. The metal member 727 is fixed to the column 21L, 21R such that the insertion portion 727*b* is inserted onto a pair of protrusions 721*p* provided on the outer surface of the plate 27*c*.

The base portion 27*x* of the receiver portion 727*a* is in contact with the outer surface of the column 21L, 21R. The insertion portion 727*b* is in contact with the outer surface of the plate 27*c*. Also in the present embodiment, a projective region obtained by projecting the insertion portion 727*b* in the vertical direction onto the imaginary plane orthogonal to the vertical direction and a projective region obtained by projecting the base portion 27*x* of the receiver portion 727*a* in the vertical direction onto the imaginary plane do not coincide with each other but are adjacent to each other.

The seventh embodiment described above offers the same advantages as those offered by the first embodiment according to the same configuration as employed in the first embodiment. Further, the metal member of the intermediate unit 20 has a reduced number of components as compared with the first embodiment, facilitating attaching of the metal member of the intermediate unit 20 to the column.

While the embodiments have been described above, it is to be understood that the disclosure is not limited to the details of the illustrated embodiments, but may be modified with various changes and modifications, which may occur to those skilled in the art, without departing from in the spirit and scope of the disclosure.

The number of first trays and the number of second trays are optional. For instance, the main body unit may include a plurality of first trays while the tray unit may include one second tray. The number of conveyance rollers provided in the intermediate unit is not limited to four, but may be any optional number equal to or larger than one. The motor for driving the conveyance rollers of the intermediate unit may be provided in the intermediate unit instead of in the tray unit. The second discharge opening of the intermediate unit may be located downstream of the first introduction opening of the intermediate unit in the first movement direction in which the medium moves when received by the second tray.

The opening and closing member is not limited to the cover of the scanner unit, but may be the housing of the scanner unit as in the third embodiment of FIG. 6 or the upper cover of the housing of the main body unit as in the fourth embodiment of FIG. 7 and the fifth embodiment of FIG. 8, namely, a cover to be opened and closed in replacement of cartridges, in a jam clearing operation, and the like. The opening and closing member is not necessarily required to be disposed below the second tray.

The structure of the drive member for moving the switcher and the structure of the transmission member for transmitting the drive force of the drive member may be changed. For instance, the drive member and the transmission member may be provided for the intermediate unit or the main body unit instead of for the tray unit. The motor and the transmission mechanism may be disposed in outer spaces located outside the pairs of columns. The connectors may be disposed in the inner space sandwiched by the pairs of columns. It is not necessarily required for each of the intermediate unit and the tray unit to include the pair of columns. The structure of each connector may be changed. The connector of the intermediate unit connecting the intermediate unit to the tray unit may be the insertion portion shaped like a plate and extending in the vertical direction, and the connector of the intermediate unit connecting the intermediate unit to the main body unit may be the receiver portion including: the base portion shaped like a plate and extending in the vertical direction; and the protruding portion horizontally protruding from the base portion and having a recess in which the insertion portion is insertable. The tray unit may be configured not to be removably mountable on the upper surface of the main body unit.

The projective point obtained by projecting the center of gravity of the motor in the vertical direction onto the imaginary plane orthogonal to the vertical direction, the projective point obtained by projecting the center of gravity of the intermediate unit in the vertical direction onto the imaginary plane, and the projective point obtained by projecting the center of gravity of the portion constituted by the intermediate unit and the tray unit in the vertical direction onto the imaginary plane are not necessarily required to be located within the projective region obtained by projecting the main body unit in the vertical direction onto the imaginary plane.

The image reader such as the scanner unit may be eliminated as in the fourth embodiment of FIG. 7 and the fifth embodiment of FIG. 8.

The present disclosure is applicable not only to the printer but also to a facsimile, a copying machine, a multi-function peripheral (MFP), and the like. The present disclosure is applicable not only to a laser image forming apparatus, an LED image forming apparatus, and an ink-jet image forming apparatus but also to a thermal image forming apparatus. Further, the ink-jet image forming apparatus is not limited to a line type but may be a serial type.

The present disclosure is applicable not only to the image forming apparatus but also to devices not equipped with the image former that includes the photoconductive drum, the ink-jet head, and the like, namely, devices configured not to perform image formation on the medium. The medium is not limited to the sheet but may be a cloth or the like.

What is claimed is:

1. A conveying apparatus, comprising:

a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit;

an intermediate unit mountable on and removable from the upper surface of the main body unit, the intermediate unit including a first introduction opening formed in a lower surface thereof so as to be opposed to the first discharge opening, a second conveyance path through which the medium that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction, and wherein the tray unit includes a motor configured to drive the at least one conveyance roller of the intermediate unit.

2. The conveying apparatus according to claim 1, wherein the length of the intermediate unit in the height direction is equal to a distance from the lower surface of the intermediate unit to the upper surface thereof, and wherein the length of the tray unit in the height direction is equal to a distance from the lower surface of the tray unit to an upper end of an uppermost one of the at least one second tray.

3. The conveying apparatus according to claim 1, wherein a projective point of a center of gravity of the motor is located within a projective region of the main body unit, the projective point being obtained by projecting the center of gravity of the motor in a vertical direction onto an imaginary plane orthogonal to the vertical direction, the projective region being obtained by projecting the main body unit in the vertical direction onto the imaginary plane.

4. The conveying apparatus according to claim 1, wherein each of the intermediate unit and the tray unit includes a pair of columns which extend in a vertical direction and which are opposed to and spaced apart from each other in a direction parallel to a horizontal direction, wherein the pair of columns of the intermediate unit are disposed so as to align with the pair of columns of the tray unit in the vertical direction, and wherein the motor and a transmission mechanism configured to transmit a drive force of the motor to the at least one conveyance roller are disposed in an inner space sandwiched by the pairs of columns in the direction in which the columns of each pair are opposed to each other.

5. The conveying apparatus according to claim 1, wherein the intermediate unit includes a pair of columns which extend in a vertical direction and which are opposed to and spaced apart from each other in a direction parallel to a horizontal direction, and wherein the at least one conveyance roller is disposed in an inner space sandwiched by the pair of columns in the direction in which the pair of columns are opposed to each other.

6. The conveying apparatus according to claim 1, wherein each of the intermediate unit and the tray unit includes a pair of columns which extend in a vertical direction and which are opposed to and spaced apart from each other in a direction parallel to a horizontal direction, and wherein a connector of the intermediate unit connecting the intermediate unit to the main body unit and a connector of the intermediate unit connecting the intermediate unit to the tray unit are disposed in each of outer spaces located outside the pair of columns of the intermediate unit in the direction in which the columns are opposed to each other, and a connector of the tray unit connecting the tray unit to the intermediate unit is disposed in each of outer spaces of located outside the pair of columns of the tray unit in the direction in which the columns are opposed to each other.

7. The conveying apparatus according to claim 1, wherein the second discharge opening of the intermediate unit is located upstream of the first introduction opening in a first movement direction in which the medium moves when received by the at least one second tray.

8. The conveying apparatus according to claim 7, wherein the main body further comprises a scanner unit and a cover configured to cover the scanner unit and disposed below the at least one second tray and above the first tray, the cover being configured to be pivotable about a shaft located on an upstream side in the first movement direction so as to extend in a direction orthogonal to the first movement direction and a vertical direction.

9. The conveying apparatus according to claim 1, wherein the first tray is disposed below the at least one second tray, wherein a first movement direction in which the medium moves when received by the at least one second tray is the same as a second movement direction in which he medium moves when received by the first tray, and wherein the first tray is disposed downstream of the first discharge opening in the second movement direction.

10. A conveying apparatus, comprising:

a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit;

an intermediate unit mountable on and removable from the upper surface of the main body unit, the intermediate unit including a first introduction opening formed in a lower surface thereof so as to be opposed to the first discharge opening, a second conveyance path through which the medium that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction, wherein the tray unit comprises an first insertion portion shaped like a plate and extending in a vertical direction, wherein the intermediate unit comprises a second insertion portion shaped like a plate and extending in a vertical direction and a first receiver portion having a recess into which the first insertion portion is insertable, wherein the main body comprises a second receiver portion having a recess into which the second insertion portion is insertable, wherein a projective region obtained by projecting the first insertion portion in the vertical direction onto an imaginary plane orthogonal to the vertical direction coincides with a projective region obtained by projecting the second insertion portion in the vertical direction onto the imaginary plane, and a projective region obtained by projecting the first receiver portion in the vertical direction onto the imaginary plane coincides with a projective region obtained by projecting the second receiver portion in the vertical direction onto the imaginary plane.

11. The conveying apparatus according to claim 10, wherein the projective region obtained by projecting the first insertion portion in the vertical direction onto the imaginary plane and the projective region obtained by projecting the first receiver portion and the projective region obtained by projecting the first receiver portion do not coincide with each other but are adjacent to each other, and the projective region obtained by projecting the second insertion portion in the vertical direction onto the imaginary plane and the projective region obtained by projecting the second receiver portion in the vertical direction onto the imaginary plane do not coincide with each other but are adjacent to each other.

12. A conveying apparatus, comprising:

a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit;

an intermediate unit mountable on and removable from the upper surface of the main body unit, the intermediate unit including a first introduction opening formed in a lower surface thereof so as to be opposed to the first discharge opening, a second conveyance path through which the medium that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction, wherein the tray unit includes a drive member configured to move the switcher, wherein the intermediate unit includes: a transmission member connected to the switcher and the drive member and configured to be movable in a vertical direction for transmitting a drive force of the drive member; and a housing supporting the transmission member, and wherein the transmission member protrudes downward from a lower surface of the housing as the lower surface of the intermediate unit when the transmission member transmits the drive force of the drive member to the switcher while the transmission member does not protrude downward from the lower surface of the housing when the transmission member does not transmit the drive force of the drive member to the switcher.

13. A conveying apparatus, comprising:

a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit;

an intermediate unit mountable on and removable from the upper surface of the main body unit, the intermediate unit including a first introduction opening formed in a lower surface thereof so as to be opposed to the first discharge opening, a second conveyance path through which the medium that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction, and wherein a projective point of a center of gravity of a portion constituted by the intermediate unit and the tray unit is located within a projective region of the main body unit, the projecting point being obtained by projecting the center of gravity of the portion constituted by the intermediate unit and the tray unit in a vertical direction onto an imaginary plane orthogonal to the vertical direction, the projective region being obtained by projecting the main body unit in the vertical direction onto the imaginary plane.

14. A conveying apparatus, comprising:

a main body unit including a conveyor mechanism configured to convey a medium through a first conveyance path, a first tray configured to receive the medium conveyed by conveyor mechanism, and a switcher configured to switch a destination of the medium conveyed by the conveyor mechanism selectively between the first tray and a first discharge opening formed in an upper surface of the main body unit;

an intermediate unit mountable on and removable from the upper surface of the main body unit, the intermediate unit including a first introduction opening formed in a lower surface thereof so as to be opposed to the first discharge opening, a second conveyance path through which the median that has passed through the first discharge opening and the first introduction opening is conveyed, and at least one conveyance roller configured to convey the medium along the second conveyance path and to discharge the medium outside the intermediate unit from a second discharge opening formed in an upper surface of the intermediate unit; and a tray unit mountable on and removable from the upper surface of the intermediate unit, the tray unit including a second introduction opening formed in a lower surface thereof so as to be opposed to the second discharge opening, a third conveyance path through which the medium that has passed through the second discharge opening and the second introduction opening is conveyed, and at least one second tray configured to receive the medium that has been conveyed through the third conveyance path, wherein a length of the intermediate unit in a height direction is smaller than a length of the tray unit in the height direction, and wherein a projective point of a center of gravity of the intermediate unit is located within a projective region of the main body unit, the projective point being obtained by projecting the center of gravity of the intermediate unit in a vertical direction onto an imaginary plane orthogonal to the vertical direction, the projective region being obtained by projecting the main body unit in the vertical direction onto the imaginary plane.

* * * * *